US007097598B2

(12) United States Patent
Lee

(10) Patent No.: US 7,097,598 B2
(45) Date of Patent: Aug. 29, 2006

(54) FOLDABLE EXERCISER

(76) Inventor: Lung-Huei Lee, No. 1, Lane 1561, Sec. 1, Chung-Shan Rd., Ta-Chia Chen, Taichung Hsien (TW)

( * ) Notice: Subject to any disclaimer, the term of this patent is extended or adjusted under 35 U.S.C. 154(b) by 0 days.

(21) Appl. No.: 11/152,159

(22) Filed: Jun. 15, 2005

(65) Prior Publication Data

US 2006/0172867 A1 Aug. 3, 2006

(51) Int. Cl.
*A63B 69/16* (2006.01)
*A63B 23/04* (2006.01)
*A63B 21/068* (2006.01)

(52) U.S. Cl. ..... 482/57; 482/62; 482/72; 482/96

(58) Field of Classification Search ..... 482/51–53, 482/57, 62, 63, 95–96
See application file for complete search history.

(56) References Cited

U.S. PATENT DOCUMENTS 2,107,447 A * 2/1938 Marlowe ..... 482/63
2,145,940 A * 2/1939 Marlowe ..... 482/72
4,300,760 A * 11/1981 Bobroff ..... 482/96
4,762,317 A * 8/1988 Camfield et al. ..... 482/62
5,549,527 A * 8/1996 Yu ..... 482/57
5,626,542 A * 5/1997 Dalebout et al. ..... 482/96
6,001,046 A * 12/1999 Chang ..... 482/57
6,132,341 A * 10/2000 Lin ..... 482/57
6,902,515 B1 * 6/2005 Howell et al. ..... 482/62
7,022,048 B1 * 4/2006 Fernandez et al. ..... 482/8

* cited by examiner

*Primary Examiner*—Stephen R. Crow
(74) *Attorney, Agent, or Firm*—Lowe, Hauptman & Berner LLP

(57) ABSTRACT

A foldable exerciser includes an operating member connected pivotally to atop end portion of a rear support member, a driving unit provided with two pedals and mounted on a front support member connected pivotally to the rear support member, a saddle-supporting member connected pivotally to the rear support member and disposed under and movable on a saddle-mounting member mounted with a saddle and connected pivotally to the rear support member, a coupling member interconnecting removably and disposed between the operating member and the saddle-supporting member, and a foldable positioning unit interconnecting the front and rear support members. When the coupling member is removed from the saddle-supporting member, the saddle-mounting member and the saddle-supporting member can be folded on the rear support member.

9 Claims, 6 Drawing Sheets

FOLDABLE EXERCISER

BACKGROUND OF THE INVENTION

1. Field of the Invention

The invention relates to an exerciser, more particularly to a foldable exerciser.

2. Description of the Related Art

Conventional stationary exercise bicycles and horse-riding exercisers are generally designed to have a non-retractable structure with a relatively large size. It is desirable to design a foldable exerciser with a combined function of the conventional stationary exercise bicycle and horse-riding exerciser.

SUMMARY OF THE INVENTION

Therefore, the object of the present invention is to provide a foldable exerciser that can function as a stationary exercise bicycle and a horse-riding exerciser and that has a minimized size when in a fully folded state.

According to the present invention, a foldable exerciser comprises:

an elongate front support member having a bottom end portion, a top end portion opposite to the bottom end portion, and an intermediate portion interconnecting fixedly the top and bottom end portions of the front support member;

an elongate rear support member having a bottom end portion, a top end portion opposite to the bottom end portion, and an intermediate portion interconnecting fixedly the top and bottom end portions of the rear support member and connected pivotally to the top end portion of the front support member, the rear support member being pivotable relative to the front support member about a first axis;

a driving unit mounted on the intermediate portion of the front support member and including parallel first and second rotating shafts journalled on the intermediate portion of the front support member and parallel to the first axis, a resistance wheel mounted fixedly on the first rotating shaft, a driving wheel mounted fixedly on the second rotating shaft, a V-belt trained on the resistance wheel and the driving wheel, and two pedal members connected respectively and fixedly to opposite ends of the second rotating shaft;

an operating member including an upper handle section, a lower coupling section opposite to the upper handle section, and an interconnecting section connected pivotally to the top end portion of the rear support member and interconnecting fixedly the upper handle section and the lower coupling section, the operating member being pivotable relative to the top end portion of the rear support member about a second axis parallel to the first axis;

a saddle-mounting member having a front end portion connected pivotally to the intermediate portion of the rear support member, and a bottom surface, the saddle-mounting member being pivotable relative to the second intermediate portion of the rear support member about a third axis parallel to the first axis;

a saddle mounted on the saddle-mounting member;

a saddle-supporting member disposed under the saddle mounting-member and having a lower end portion connected pivotally to the intermediate portion of the rear support member, and an upper end portion movable on the bottom surface of the saddle-mounting member, the saddle-supporting member being pivotable relative to the intermediate portion of the rear support member about a fourth axis parallel to the first axis; and a coupling member connected to and disposed between the lower coupling section of the operating member and the saddle-supporting member such that rearward pivoting movement of the operating member about the second axis results in upward pivoting movement of the saddle about the third axis so as to simulate a horse-riding action, the coupling member being removable from the saddle-supporting member so as to allow the saddle-mounting member, the saddle and the saddle-supporting member to be all folded on the rear support member; and a positioning unit interconnecting the front and rear support members so as to prevent relative rotation between the front and rear support members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
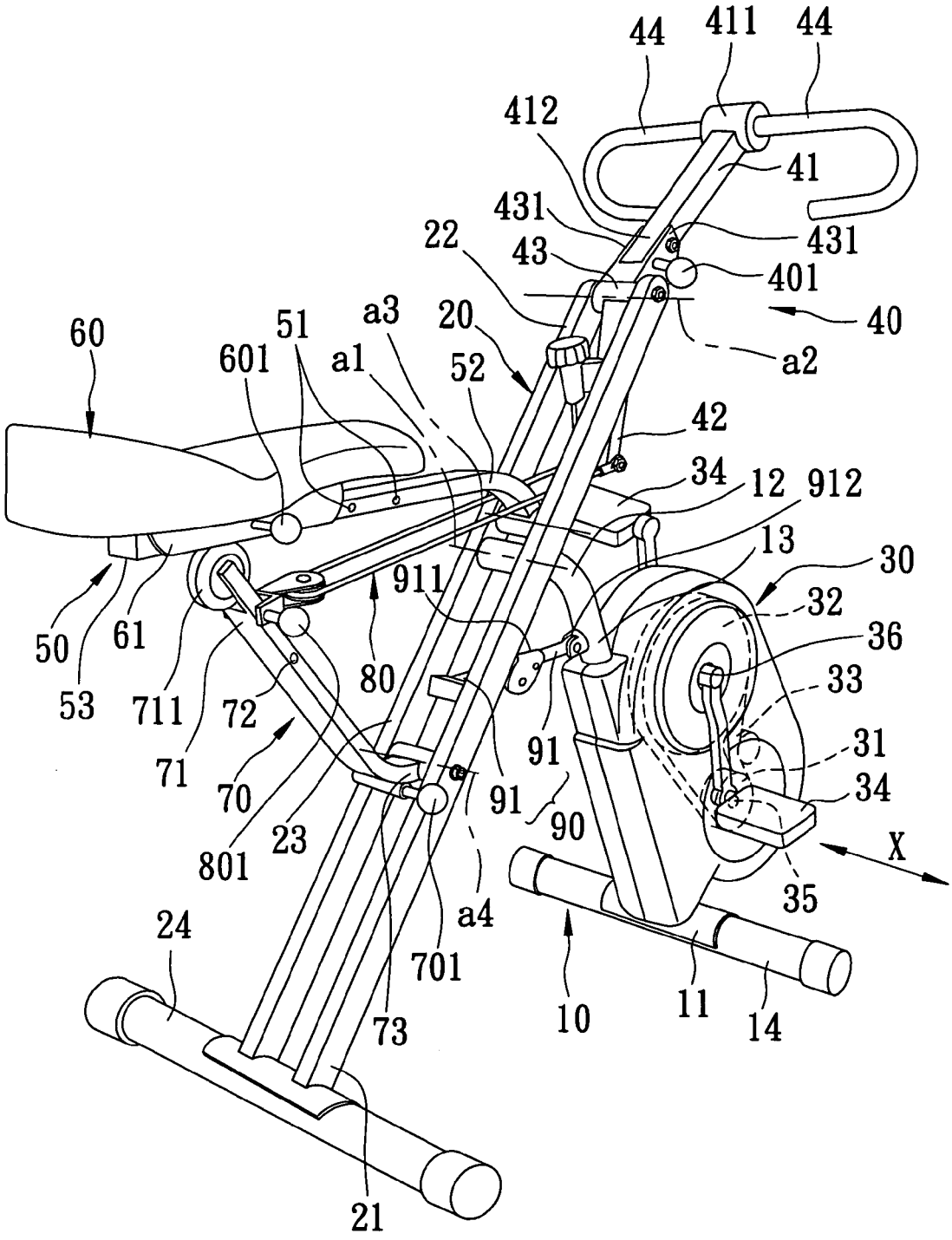
FIG. 1 is a perspective view showing the preferred embodiment of a foldable exerciser according to the present invention.
Figure 2:
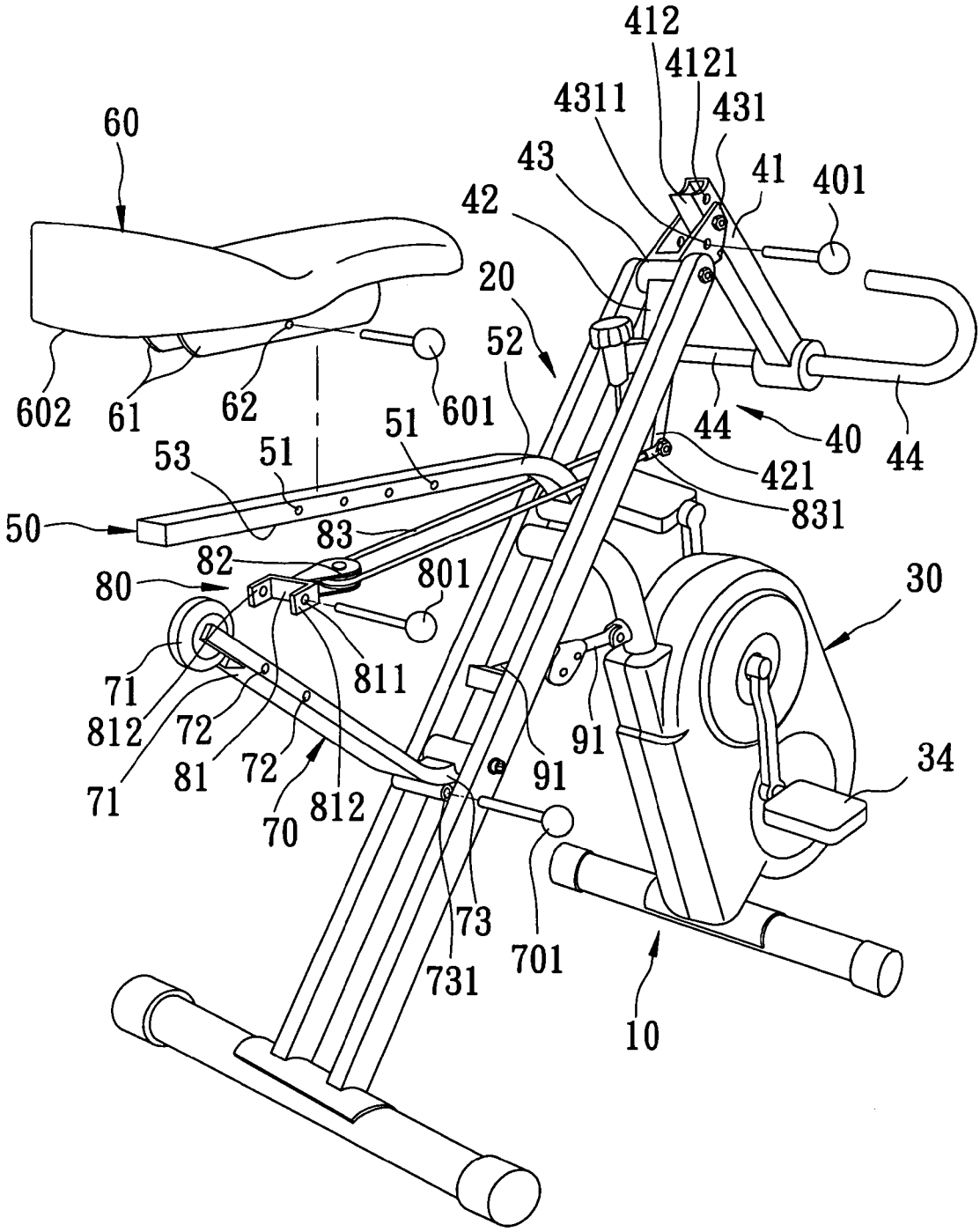
FIG. 2 is a partly exploded perspective view showing the preferred embodiment.
Figure 3:
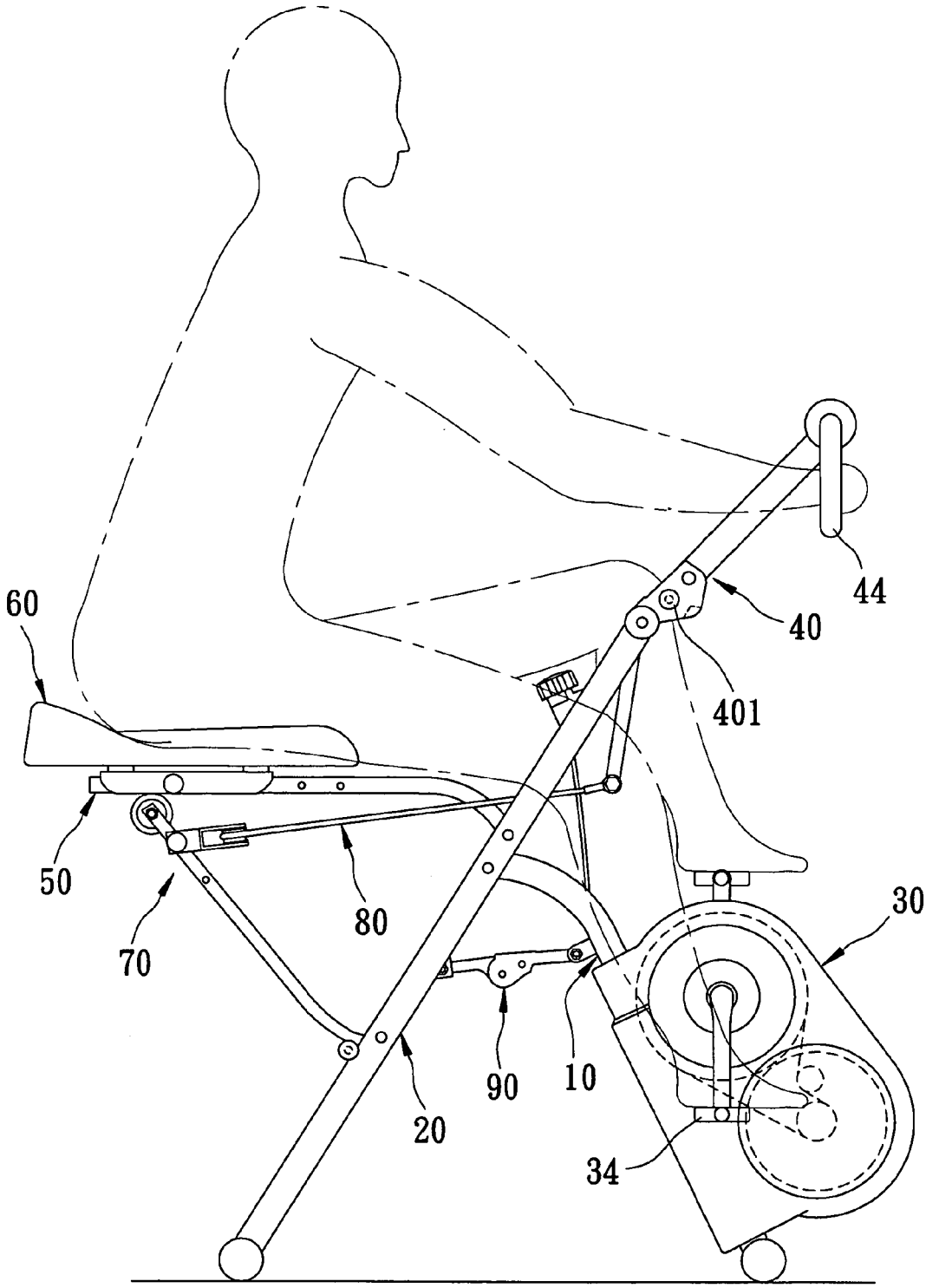
FIG. 3 is a schematic view showing the preferred embodiment in a state of use.

Referring to FIGS. 1, 2 and 3, the preferred embodiment of a foldable exerciser according to the present invention is shown to include an elongate front support member 10, an elongate rear support member 20, a driving unit 30, an operating member 40, a saddle-mounting member 50, a saddle 60, a saddle-supporting member 70, a coupling member 80, and a positioning unit 90.

The front support member 10 has a bottom end portion 11, a top end portion 12 opposite to the bottom end portion 11, and an intermediate portion 13 interconnecting fixedly the top and bottom end portions 12, 11 of the front support member 10. In this embodiment, the bottom end portion 11 is provided with an elongate rod 14 that extends along a direction (X).

The rear support member 20 has a bottom end portion 21 provided with an elongate rod 24 that extends along the direction (X), a top end portion 22 opposite to the bottom end portion 21, and an intermediate portion 23 interconnecting fixedly the top and bottom end portions 22, 21 of the rear support member 20 and connected pivotally to the top end portion 12 of the front support member 10. The rear support member 20 is pivotable relative to the front support member 10 about a first axis (a1) parallel to the direction (X).

The driving unit 30 is mounted on the intermediate portion 13 of the front support member 10, and includes parallel first and second rotating shafts 35, 36, a resistance wheel 31, a driving wheel 32, a V-belt 33, and two pedal members 34, as shown in FIG. 1. The first and second rotating shafts 35, 36 are journalled on the intermediate portion 13 of the front member 10, and extend along the direction (X). The resistance wheel 31 is mounted fixedly on the first rotating shaft 35. The driving wheel 32 is mounted fixedly on the second rotating shaft 36. The V-belt 33 is trained on the resistance wheel 31 and the driving wheel 32. The pedal members 34 are connected respectively and fixedly to opposite ends of the second rotating shaft 36.

Figure 5:
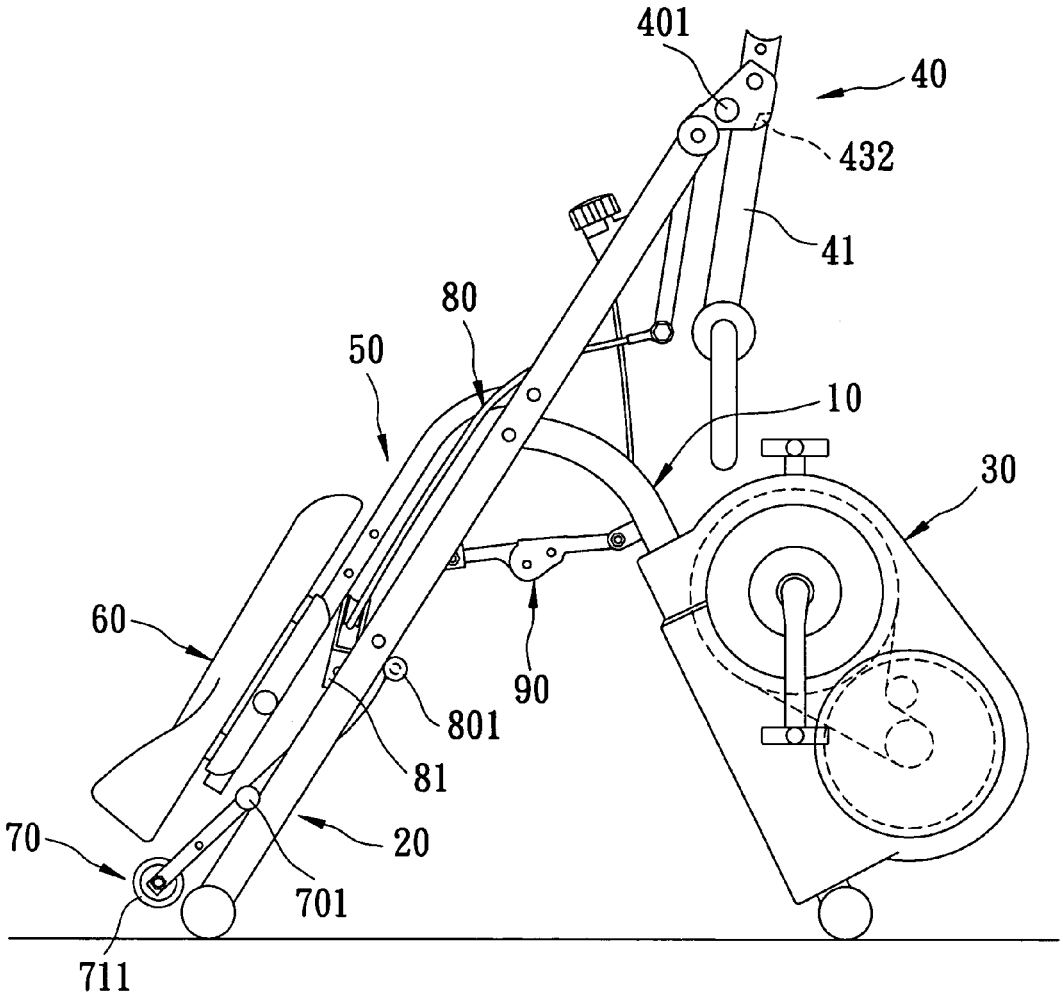
FIG. 5 is a schematic view showing the preferred embodiment in a partly folded state.
Figure 6:
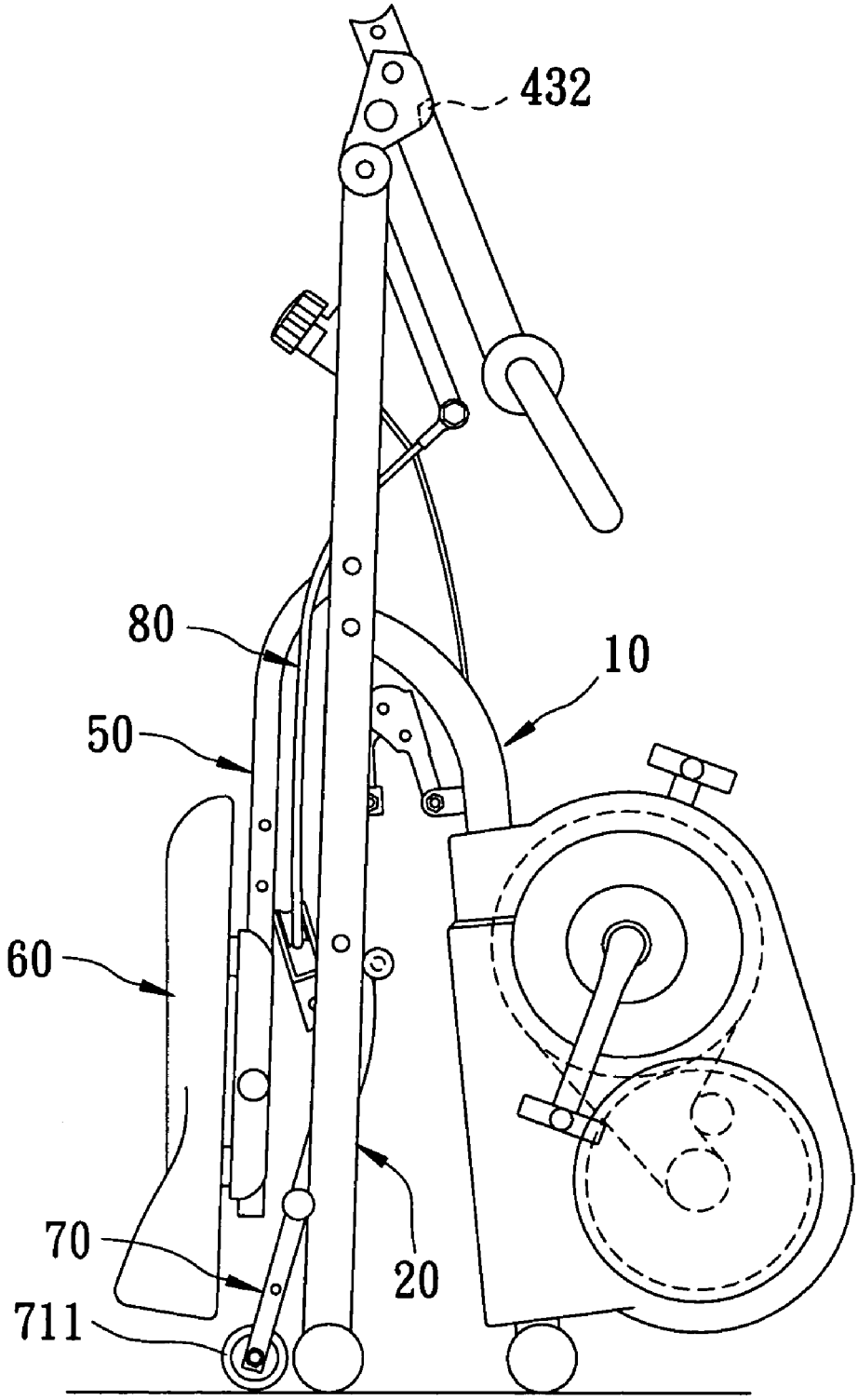
FIG. 6 is a schematic view showing the preferred embodiment in a fully folded state.

The operating member 40 includes an upper handle section 41, a lower coupling section 42 opposite to the upper handle section 41, and an interconnecting section 43 connected pivotally to the top end portion 22 of the rear support member 20 and interconnecting fixedly the upper handle section 41 and the lower coupling section 42. The operating member 40 is pivotable relative to the top end portion 22 of the rear support member 20 about a second axis (a2) parallel to the first axis (a1). In this embodiment, the upper handle section 41 has a free end 411 provided with two handle rods 44 that extend away from each other along the direction (X), and a coupling end 412 opposite to the free end 411 and formed with a through hole 4121 (see FIG. 2). The interconnecting section 43 is formed with a pair of parallel vertical coupling plates 431 that are interconnected fixedly. Each of the coupling plates 431 is formed with a through hole 4311 (see FIG. 2). The coupling end 412 of the handle section 41 is coupled pivotally between the coupling plates 431 of the interconnecting section 43. The operating member 40 further includes a positioning pin 401 extending through the through holes 4311 in the coupling plates 431 of the interconnecting section 43 and the through hole 4121 in the coupling end 412 of the upper handle section 41 so as to prevent rotation of the upper handle section 41 relative to the interconnecting section 43. On the other hand, the positioning pin 401 is connected removably to the coupling plates 431 of the interconnecting section 43 and the coupling end 412 of the upper handle section 41, and is removable therefrom so as to allow the upper handle section 41 to be folded on the lower coupling section 42. It is noted that each of the coupling plates 431 of the interconnecting section 43 is pressed to form a projection 43 on an inner surface thereof such that the upper handle section 41 contacts frictionally the projections 432 when the upper handle section 41 is in a folded state, as shown in FIGS. 5 and 6.

The saddle-mounting member 50 has a front end portion 52 connected pivotally to the intermediate portion 23 of the rear support member 20, and a bottom surface 53. The saddle-mounting member 50 is pivotable relative to the second intermediate portion 23 of the rear support member 20 about a third axis (a3) parallel to the first axis (a1). In this embodiment, the saddle-mounting member 50 is formed with a plurality of positioning holes 51, as best shown in FIG. 2.

The saddle 60 is mounted on the saddle-mounting member 50. In this embodiment, the saddle 60 has a bottom surface 602 that is formed two parallel vertical mounting plates 61, each of which is formed with a through hole 62. The saddle-mounting member 50 extends between the mounting plates 61. The saddle 60 further has a positioning pin 601 that extends through the holes 62 in the mounting plates 61 of the saddle 60 and a selected one of the positioning holes 51 in the saddle-mounting member 50.

The saddle-supporting member 70 is disposed under the saddle-mounting member 50, and has a lower end portion 73 connected pivotally to the intermediate portion 23 of the rear support member 20, and an upper end portion 71 movable on the bottom surface 53 of the saddle-mounting member 50. The saddle-supporting member 70 is pivotable relative to the intermediate portion 23 of the rear support member 20 about a fourth axis (a4) parallel to the first axis (a1). In this embodiment, the upper end portion 71 is provided with a rotatable pulley 711 movable on the bottom surface 53 of the saddle-mounting member 50. The saddle-supporting member 70 is formed with two positioning holes 72. The lower end portion 73 is formed with a through hole 731. The saddle-supporting member 70 further has a stop pin 701 that extends through the through hole 731 in the lower end portion 73 so as to prevent rearward pivoting movement of the saddle-supporting member about the fourth axis (a4).

Figure 4:
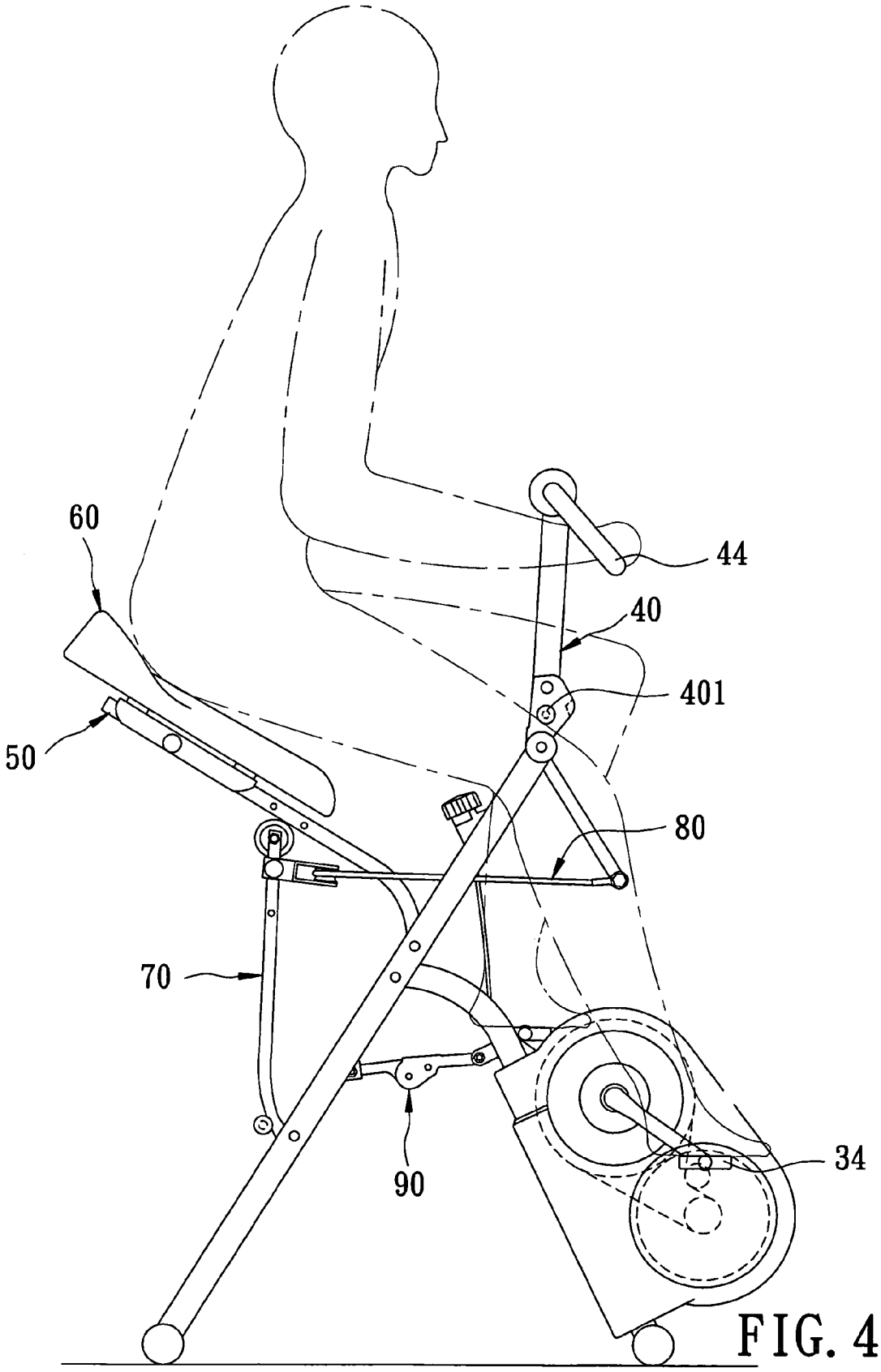
FIG. 4 is a schematic view showing the preferred embodiment in another state of use.

The coupling member 80 is connected to and is disposed between the lower coupling section 42 of the operating member 40 and the saddle-supporting member 70 such that rearward pivoting movement of the operating member 40 about the second axis (a2) results in upward pivoting movement of the saddle-mounting member 50 about the third axis (a3) due to forward pivoting movement of the saddle-supporting member 70 about the fourth axis (a4) so as to simulate a horse-riding action, as shown in FIG. 4. The coupling member 80 is removable from the saddle-supporting member 70 so as to allow the saddle-mounting member 50, the saddle 60 and the saddle-supporting member 70 to be all folded on the rear support member 20, as shown in FIG. 5.

In this embodiment, the coupling member 80 includes a U-shaped plate 81, a pulley 82, and a rope 83. The U-shaped plate 81 has two side plate portions 812 flanking the saddle-supporting member 70. The pulley 82 is mounted on and is disposed in front of the U-shaped plate 81. The rope 83 extends around the pulley 82, and has two ends fastened to a lower end 421 of the lower coupling section 42 of the operating member 40. The coupling member 80 further includes a pivot pin 801 extending through and connected removably to the side plate portions 812 of the U-shaped plate 81 and the saddle-supporting member 70. The pivot pin 801 also extends through a selected one of the positioning holes 72 in the saddle-supporting member 70.

The positioning unit 90 interconnects the front and rear support members 10, 20 so as to prevent relative rotation between the front and rear support members 10, 20. In this embodiment, the positioning unit 90 includes two horizontal links 91 connected respectively to the front and rear support members 10, 20 and disposed below the first axis (a1). Each of the links 91 has an inner end 911 and an outer end 912. The inner ends 911 are interconnected pivotally. The outer ends 912 are connected respectively and pivotally to the front 10 and rear support members 10, 20.

In use, the foldable exerciser of the present invention can be operated as a stationary exercise bicycle, as shown in FIG. 3, or a horse-riding exerciser, as shown in FIG. 4. On the other hand, when the positioning pin 401, the stop pin 701 and the pivot pin 801 are removed, the foldable exerciser can be changed to a partly folded state shown in FIG. 5. In the partly folded state, the upper handle section 41 is folded on the lower coupling section 42, and the saddle-mounting member 50 and the saddle-supporting member 70 are folded on the rear support member 20. Subsequently, the positioning unit 90 is folded so as to enable the front and rear support members 10, 20 to move toward each other. As a result, the foldable exerciser is in a fully folded state, as shown in FIG. 6. It is noted that, due to the presence of the pulley 711, the foldable exerciser of this invention can be easily moved on the ground when in the fully folded state.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable exerciser comprising:

an elongate front support member having a bottom end portion, a top end portion opposite to said bottom end portion, and an intermediate portion interconnecting fixedly said top and bottom end portions of said front support member;

an elongate rear support member having a bottom end portion, a top end portion opposite to said bottom end portion, and an intermediate portion interconnecting fixedly said top and bottom end portions of said rear support member and connected pivotally to said top end portion of said front support member, said rear support member being pivotable relative to said front support member about a first axis;

a driving unit mounted on said intermediate portion of said front support member and including parallel first and second rotating shafts journalled on said intermediate portion of said front support member and parallel to said first axis, a resistance wheel mounted fixedly on said first rotating shaft, a driving wheel mounted fixedly on said second rotating shaft, a V-belt trained on said resistance wheel and said driving wheel, and two pedal members connected respectively and fixedly to opposite ends of said second rotating shaft;

an operating member including an upper handle section, a lower coupling section opposite to said upper handle section, and an interconnecting section connected pivotally to said top end portion of said rear support member and interconnecting fixedly said upper handle section and said lower coupling section, said operating member being pivotable relative to said top end portion of said rear support member about a second axis parallel to the first axis;

a saddle-mounting member having a front end portion connected pivotally to said intermediate portion of said rear support member, and a bottom surface, said saddle-mounting member being pivotable relative to said second intermediate portion of said rear support member about a third axis parallel to the first axis;

a saddle mounted on said saddle-mounting member;

a saddle-supporting member disposed under said saddle-mounting member and having a lower end portion connected pivotally to said intermediate portion of said rear support member, and an upper end portion movable on said bottom surface of said saddle-mounting member, said saddle-supporting member being pivotable relative to said intermediate portion of said rear support member about a fourth axis parallel to the first axis; and a coupling member connected to and disposed between said lower coupling section of said operating member and said saddle-supporting member such that rearward pivoting movement of said operating member about said second axis results in upward pivoting movement of said saddle about said third axis so as to simulate a horse-riding action, said coupling member being removable from said saddle-supporting member so as to allow said saddle-mounting member, said saddle and said saddle-supporting member to be all folded on said rear support member; and a positioning unit interconnecting said front and rear support members so as to prevent relative rotation between said front and rear support members.

2. The foldable exerciser as claimed in claim 1, wherein said upper handle section of said operating member has a free end provided with two handle rods that extend away from each other, and a coupling end opposite to said free end, said interconnecting section being formed with a pair of parallel vertical coupling plates that are interconnected fixedly, said coupling end of said handle section being coupled pivotally between said coupling plates, said operating member further including a positioning pin extending through said coupling plates of said interconnecting section and said coupling end of said upper handle section so as to prevent rotation of said upper handle section relative to said interconnecting section.

3. The foldable exerciser as claimed in claim 2, wherein said positioning pin is connected removbly to said coupling plates of said interconnecting section and said coupling end of said upper handle section, and is removable threrfrom so as to allow said upper handle section to be folded on said lower coupling section.

4. The foldable exerciser as claimed in claim 1, wherein said saddle has a bottom surface that is formed with two parallel vertical mounting plates, each of which is formed with a through hole, said saddle-mounting member extending between said mounting plates and being formed with a plurality of positioning holes, said saddle further having a positioning pin that extends through said through holes in said mounting plates of said saddle and a selected one of said positioning holes in said saddle-mounting member.

5. The foldable exerciser as claimed in claim 1, wherein said upper end portion of said saddle-supporting member is provided with a rotatable pulley movable on said bottom surface of said saddle-mounting member.

6. The foldable exerciser as claimed in claim 1, wherein said positioning unit includes two horizontal links connected respectively to said front and rear support members and disposed below said first axis, each of said links having an inner end and an outer end, said inner ends being interconnected pivotally, said outer ends being connected respectively and pivotally to said front and rear support members.

7. The foldable exerciser as claimed in claim 1, wherein said coupling member includes:

a U-shaped plate having two side plate portions flanking said saddle-supporting member;

a pulley mounted on and disposed in front of said U-shaped plate; and a rope extending around said pulley and having two ends fastened to a lower end of said lower coupling section of said operating member;

said coupling member further including a pivot pin extending through and connected removably to said side plate portions of said U-shaped plate and said saddle-supporting member, said coupling member being removed from said saddle-supporting member when said pivot pin is removed from said U-shape plate and saddle supporting member.

8. The foldable exerciser as claimed in claim 7, wherein said saddle-supporting member is formed with a plurality of positioning holes, said pivot pin extending through a selected one of said positioning holes in said saddle-supporting member.

9. The foldable exerciser as claimed in claim 1, wherein said lower end portion of said saddle-supporting member is formed with a through hole, said saddle-supporting member further having a stop pin that extends through said through hole in said lower end portion and that abuts against said rear supporting member so as to prevent rearward pivoting movement of said saddle-supporting member about said fourth axis, said stop pin being removable from said saddle-supporting member so as to allow rearward pivoting movement of said saddle-supporting member.

* * * * *